US005589321A

United States Patent [19]

Matsuda

[11] Patent Number: 5,589,321

[45] Date of Patent: Dec. 31, 1996

[54] METHOD OF AND APPARATUS FOR CONTROLLING DRYING OF PHOTOGRAPHIC MATERIAL

[75] Inventor: Shinichi Matsuda, Kanagawa, Japan

[73] Assignee: Fuji Photo Film Co., Ltd., Kanagawa, Japan

[21] Appl. No.: 277,168

[22] Filed: Jul. 19, 1994

[30] Foreign Application Priority Data

Jul. 20, 1993 [JP] Japan ..... 5-179373

[51] Int. Cl.[6] ..... G03C 1/725; G03C 1/73; G03C 5/18; G03C 5/26

[52] U.S. Cl. ..... 430/432; 430/30; 430/350; 430/403; 34/620; 34/624; 34/543; 34/549; 34/420; 34/557

[58] Field of Search ..... 430/30, 350, 403, 430/432; 34/68, 445, 419, 420, 535, 543, 549, 557, 620, 624; 219/469, 470, 292, 297; 340/588, 589

[56] References Cited

U.S. PATENT DOCUMENTS

| | | | |
|---|---|---|---|
| 3,834,040 | 9/1974 | Russell et al. | 34/160 |
| 4,139,953 | 2/1979 | Gaskell | 34/445 |
| 4,222,178 | 9/1980 | Moran | 34/445 |
| 4,495,713 | 1/1985 | Williner | 34/68 |
| 4,952,960 | 8/1990 | Kosugi et al. | 34/535 |
| 5,032,493 | 7/1991 | Mori et al. | 430/432 |
| 5,068,681 | 11/1991 | Kosugi et al. | 34/535 |
| 5,079,853 | 1/1992 | Kurokawa | 34/620 |
| 5,097,605 | 3/1992 | Kashino et al. | 34/419 |
| 5,323,546 | 6/1994 | Glover et al. | 34/68 |
| 5,337,499 | 8/1994 | Isozaki | 34/620 |
| 5,369,894 | 12/1994 | Schaffer et al. | 34/549 |
| 5,404,656 | 4/1995 | Matsuda et al. | 34/535 |
| 5,410,382 | 4/1995 | Matsuda et al. | 34/68 |
| 5,452,524 | 9/1995 | Isozaki et al. | 34/620 |

FOREIGN PATENT DOCUMENTS

| | | | |
|---|---|---|---|
| 2520749 | 11/1975 | Germany | 34/549 |
| 53-41524 | 11/1978 | Japan | 34/557 |
| 1-260447 | 10/1989 | Japan . | |
| 2-25684 | 1/1990 | Japan | 34/557 |
| 3-181782 | 8/1991 | Japan | 34/557 |
| 475346 | 7/1992 | Japan . | |
| 4-323647 | 11/1992 | Japan | 430/432 |
| 5-2256 | 1/1993 | Japan . | |
| 5-45855 | 2/1993 | Japan . | |
| 5-53286 | 5/1993 | Japan . | |
| 699303 | 11/1979 | U.S.S.R. | 34/557 |
| 706664 | 12/1979 | U.S.S.R. | 34/549 |
| 712630 | 1/1980 | U.S.S.R. | 34/549 |
| 90-09621 | 8/1990 | WIPO | 34/549 |

OTHER PUBLICATIONS

Patent Abstract of Japan, vol. 65, No. 885, Mar. 2, 1989, JPA 1–55563.

Patent Abstract of Japan, vol. 28, No. 1097, Jun. 8, 1990, JPA 2–149845.

Patent Abstract of Japan, vol. 133, No. 988, Oct. 17, 1989, JPA 1–260448.

Patent Abstract of Japan, vol. 27, No. 1247, Jun. 6, 1991, JPA 3–132659.

Patent Abstract of Japan, vol. 73, No. 1092, May 30, 1990, JPA 2–140741.

Patent Abstract of Japan, vol. 8, No. 1422, May 28, 1992, JPA 4–155334.

Patent Abstract of Japan, vol. 52, No. 1580, Mar. 26, 1993, JPA 5–72708.

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A method of and an apparatus for controlling drying of a photographic material in which, by controlling respective temperatures of a contact-heating device and warm air, temperatures can be controlled to the minimum temperature necessary to provide the photographic material with optimal effects so that the relative contributions of drying the photographic material by the contact-heating device and the warm air are always constant.

6 Claims, 5 Drawing Sheets

PROCESSING TIME: 30-SECOND PROCESSING
SIZE OF PHOTOSENSITIVE MATERIAL: BIG SQUARE (14 x 14 INCH)
INSERTION INTERVAL: 1 SECOND
TEMPERATURE AND HUMIDITY OF ENVIRONMENT: 25°C, 50%RH

METHOD OF AND APPARATUS FOR CONTROLLING DRYING OF PHOTOGRAPHIC MATERIAL

BACKGROUND OF THE INVENTION

1. Field of the Invention

The present invention relates to a method of and an apparatus for controlling the drying of a photographic material in which the photographic material is dried by a combination of a heat roller and warm air, the temperatures of both the heat roller and the warm air being relatively controlled.

2. Description of the Related Art

A photographic material, onto which an image has been exposed, is successively subjected to some processes such as developing, fixing, and washing by respective processing solutions such as a developing solution, fixing solution, and washing water. Thereafter, the photographic material is subject to drying in a drying section.

Usually, the drying section comprises a plurality of conveying rollers through which the photographic material passes with nip or without nip. Both surfaces of the photographic material contact the conveying rollers and the photographic material is conveyed by the driven conveying rollers.

Here, an arrangement of the drying section in which drying air blow ports are disposed between the respective rollers is known. When the photographic material passes between the rollers, the drying air is blown thereon from the blow ports. The photographic material is thereby dried by the drying air.

Recently, a request for reducing the entire processing time of the processing apparatus has been made, especially with regards to drying time. Accordingly, the drying efficiency of the apparatus must be increased. In order to meet this request, we have proposed an arrangement in which heat rollers have been used as the conveying rollers in the drying section so as to heat the photographic material and efficiently evaporate moisture contained therein.

Consequently, the moisture content of the photographic material, even if it exceeds the amount of saturated moisture immediately after processing, is efficiently evaporated from the photographic material heated by contacting the heat rollers and then the moisture evaporated from the photographic material is removed from the surfaces of the photographic material by drying air. Drying efficiency is thereby increased. Drying efficiency is further increased by repeating heating by the heat rollers and the blowing of drying air. Thus the entire processing time can thereby be reduced without reducing the time of the developing, fixing and washing processes.

However, in a drying device which uses a combination of such heat rollers and drying air, the temperatures of the heat rollers and the warm air which serves as drying air are irrespectively controlled. That is, the effectiveness for drying the photographic material (the effect which contributes to the drying of the photographic material, and hereinafter, will be referred to as relative "contribution" or "percent contribution") by the heat rollers and the drying air has not been taken into account. For this reason, when the temperatures of the heat rollers and the warm air are set while the surface temperatures of the heat rollers (and other rollers as well) are low, the relative contribution of the drying air needs to be raised by raising the temperature of the drying air because the drying ability of the entire drying section decreases. As a result, the capacity of a heater for heating the drying air must be increased. Moreover, heat resistance of the drying section and its peripheral components must be raised.

Further, when the relative contribution of the drying by the heat rollers is excessively high, the quality of the images may deteriorate due to drying irregularities or the like.

SUMMARY OF THE INVENTION

With the aforementioned in view, an object of the present invention is to obtain a method of and an apparatus for controlling drying of a photographic material in which, when the photographic material is dried by using a combination of drying by warm air and drying by heat rollers, the temperatures of the warm air and the heat rollers can be controlled to the minimum temperature necessary to provide the photographic material with optimal effects.

In the first aspect of the present invention, a method of controlling drying of a photographic material in which, after a photosensitive material, which has been processed by processing solutions, the resulting photographic material is heated by a contact-heating device such as a heat roller, warm air is blown onto said photographic material, comprising a step of: controlling temperatures of said contact-heating device and the warm air so that the relative contribution of drying of said photographic material by said contact-heating device and the warm air are always constant.

In the second aspect of the present invention, a method of controlling drying of a photographic material in which, after a photosensitive material, which has been processed by processing solutions, the resulting photographic material is heated mainly by contacting a plurality of rollers including at least one heat roller, warm air is blown onto said photographic material, comprising a step of: successively setting average surface temperatures of the rollers, which contact the photographic material and which include said heat roller, and the temperature of said warm air so that a difference between the average surface temperatures of the rollers and a surface temperature of said photographic material and a difference between the temperature of the warm air and the surface temperature of said photographic material are respectively kept constant.

In the third aspect of the present invention, a method of controlling drying of a photographic material, wherein said set temperatures are corrected on the basis of an amount of the photographic material which is dried per unit of time.

In the fourth aspect of the present invention, a method of controlling drying of a photographic material in which, after a photographic material, which has been processed by processing solutions, the resulting photographic material is heated mainly by contacting a plurality of rollers including a heat roller or heat rollers, drying is finished by blowing warm air onto said photosensitive material, comprising steps of: obtaining environmental absolute humidity which can be calculated from the environmental temperature and relative humidity and an amount of the photographic material which is dried per unit of time by direct detection or calculation; and setting or controlling an average surface temperature of the rollers including said heat rollers and a temperature of the warm air on the basis of the environmental absolute humidity and the amount of the photographic material which is dried per unit of time.

In the fifth aspect of the present invention, an apparatus for controlling drying of a photographic material which includes a drying section, wherein after a photosensitive material, which has been processed by processing solutions, the resulting photographic material is conveyed by line of rollers including a heat roller, and is blown warm air onto the photographic material, comprising: a temperature sensor which detects a surface temperature of the photographic material immediately before said photographic material is conveyed to said drying section; a temperature setting device which sets an average surface temperature of the rollers including said heat roller and a temperature of the warm air so that a difference between the average surface temperatures of the rollers and the surface temperature of the photographic material, which is detected by said temperature detecting sensor, and a difference between the temperature of the warm air and the surface temperature of the photographic material are respectively kept constant; a dried amount detecting device which detects an amount of the photographic material which is dried per unit of time in said drying section; and a correcting device which corrects the temperature set by said temperature setting device on the basis of the dried amount of the photographic material which is detected per unit of time by said dried amount detecting device.

In accordance with the first aspect of the present invention, the temperature of the contact-heating device and the temperature of the warm air are controlled so that the relative contribution of the contact-heating device, for example, heat rollers to the drying of the photographic material and the relative contribution of the drying air (the warm air) to the drying of the photographic material are always constant. Accordingly, the quality of the images of the photosensitive material can be maintained.

In accordance with the second aspect of the present invention, the average surface temperature of the line of rollers and the temperature of the drying air are successively set so that the difference between the surface temperature of the photographic material inserted into the drying section and the average surface temperature of the line of rollers is kept constant and the difference between the surface temperature of the photographic material and the temperature of the drying air is kept constant. Namely, if the respective differences are constant, respective drying effects (relative contribution) on the photographic material become constant. As a result, the photographic material can be efficiently and optimally dried at the minimum temperature necessary to dry the photographic material.

As is mentioned before, the relative or percent contribution is a relative contribution to the drying of the photographic material. For example, assuming that the relative or percent contribution of the line of rollers which are formed by the heat rollers and the conveying rollers, which contact the photographic material, to the photographic material is $R_{HR}$%, the relative or percent contribution of the drying air to the photographic material is $R_W$%, and a total contribution to the photographic material is R(100)%, $R_{HR}+R_W=R$. $R_{HR}$, $R_W$ are determined by types of photographic material, an amount of the photographic material which is processed per unit of time, and a total processing time which includes processing conditions (processing solution processing, drying processing) of the photographic material.

In order to dry the photographic material at the determined relative contribution, the difference between the surface temperature of the photographic material and the surface temperatures of the line of rollers and the difference between the surface temperature of the photographic material and the temperature of the warm air should be constant.

In accordance with the third aspect of the present invention, the temperature and relative humidity inside the drying section change as the amount of the photographic material which is processed per unit of time increases. In particular, the relative humidity tends to become high and the drying ability lowers at that rate. Consequently, by correcting the set temperatures on the basis of the amount of the photographic material which is dried per unit of time (hereinafter, the "dried amount" of the photographic material), drying performance of the photographic material can be maintained uniformly from the beginning to the end of drying and the drying ability (the degree of drying) of the photographic material can be kept constant.

In accordance with the fourth aspect of the present invention, a map which gives the average surface temperature of the line of rollers and the temperature of the warm air from the environmental temperature and relative humidity and the dried amount of the photographic material per unit of time as parameters, is prepared, for example, by advance experimentation or the like so as to be stored. The environmental temperature and relative humidity provide one absolute humidity.

In accordance with the environmental temperature and relative humidity and the dried amount of the photographic material per unit of time which are obtained by detection or calculation, one pair of the average surface temperature of the line of rollers and the temperature of the warm air are selected (read) from the map so as to be subjected to temperature control.

Accordingly, the respective relative contribution of the heat drying by contacting the line of rollers including heat rollers and warm air drying become constant. The photographic material can be efficiently and optimally dried by a minimum temperature necessary to dry the photographic material.

Each value can be tabled as a map of the average surface temperature of the line of rollers and the temperature of the warm air. By storing the table in a control part of the drying section, the average temperature of rollers and the temperature of the warm air can be automatically controlled. An operator may manually set the values while looking at the data table. Or, he/she may previously set the calculation formula and calculate the temperature as desired.

In accordance with the fifth aspect of the present invention, the temperature sensor is disposed immediately before the drying section. As for this temperature sensor, a sensor, which can detect the surface temperature of the photographic material without contacting the photographic material and uses, for example, infrared rays, is preferable in order to prevent damage to the photosensitive material.

The temperature sensor detects the surface temperature of the photographic material immediately before the photographic material, which has been processed by the processing solution, is inserted into the drying section.

The temperature setting device sets the average surface temperature of the line of rollers and the temperature of the warm air. At this time, the difference between the surface temperature of the photographic material and the average surface temperature of the line of rollers, and the difference between the surface temperature of the photographic material and the temperature of the warm air are respectively set constant.

Accordingly, abilities of drying the photographic material by contacting the line of rollers and by blowing the warm air can be kept constant.

Next, the dried amount detecting device detects the amount of the photographic material which is dried per unit of time (the dried amount). The detection correcting device corrects the respective temperatures which have been set by the temperature setting device on the basis of the dried amount of the photographic material per unit of time.

Consequently, even if the environmental temperature and humidity of the drying section changes in accordance with the drying of the photographic material, stable drying ability at the beginning of drying can be maintained.

As described hereinbefore, a method of and an apparatus for controlling drying of the photographic material relating to the present invention achieves an excellent effect in that, when the photographic material is dried by a combination of drying by warm air and drying by the heat rollers, the temperatures of the warm air and the heat rollers can be controlled to the minimum temperature necessary to provide the photographic material with optimal effects.

DESCRIPTION OF THE PREFERRED EMBODIMENTS

Figure 1:
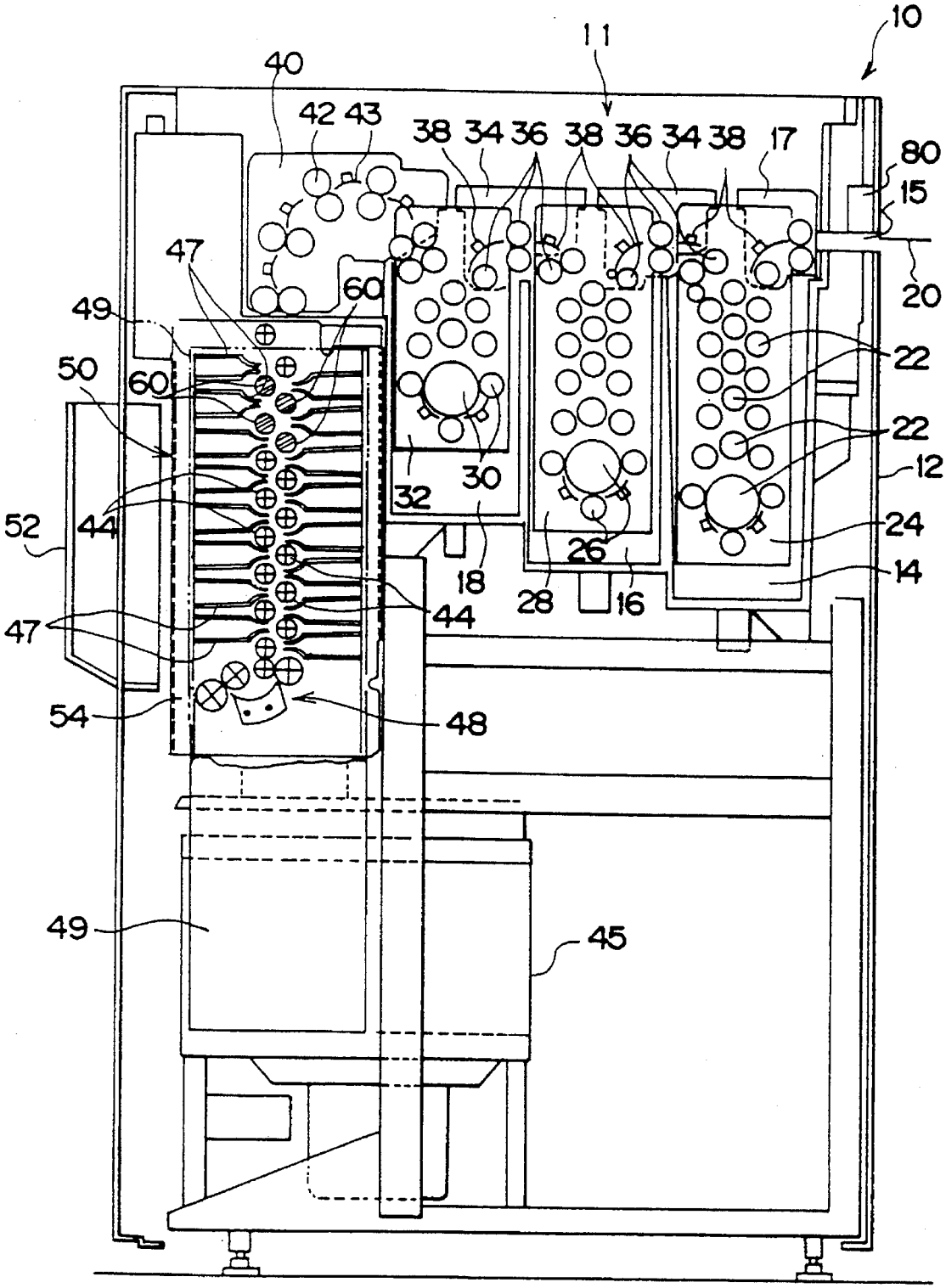
FIG. 1 is a schematic structural view of an automatic developing apparatus relating to the present embodiment.

FIG. 1 shows an automatic developing apparatus 10, as a photosensitive material processing apparatus, is applied to the present invention. The automatic processing apparatus 10 processes a film 20, which is an example of the photosensitive material, by immersing it in developing solution, fixing solution and washing water. Thereafter, the film 20 is subjected to drying processing.

The automatic developing apparatus 10 is provided with a processing solution processing section 11 and a drying section 50, all of which are inside a machine casing 12. The processing solution processing section 11 includes a developing tank 14 which stores developing solution, a fixing tank 16 which stores fixing solution, and a washing tank 18 which stores washing water. An insertion rack 17, which draws the film 20 into the machine casing 12, and an insertion detecting sensor 80, which detects the film 20 being inserted, are disposed in a vicinity of an insertion opening 15 provided inside the machine casing 12. The insertion detecting sensor 80 is connected to a control unit 64 (see FIG. 3).

Conveying racks 24, 28 and 32, having a plurality of respective conveying rollers 22, 26 and 30, are respectively disposed within the developing tank 14, the fixing tank 16 and the washing tank 18 of the processing solution processing section 11 so as to be immersed in the developing solution, the fixing solution and the washing water. Further, a crossover rack 34, which includes conveying rollers 36 and guides 38, is disposed above the developing tank 14, the fixing tank 16 and the washing tank 18. The crossover racks 34 are respectively provided between the developing tank 14 and the fixing tank 16, and the fixing tank 16 and the washing tank 18.

The film 20, which has been inserted through the insertion opening 15, is drawn into the processing solution processing section 11 by a pair of rollers in the insertion rack 17. The film 20 is then conveyed by the rotational drive of the conveying rollers 22, 26 and 36 so as to be successively immersed in the developing solution, the fixing solution and the washing water, and thereby, being subjected to developing processing, fixing processing and washing processing.

A squeeze rack 40 is disposed between the washing tank 18 and the drying section 50. The squeeze rack 40 includes squeeze rollers 42, which convey the film 20 while squeezing moisture from the surfaces thereof, and guides 43, which guide the film 20 to a drying section 50. As the film 20, which was conveyed out of the washing tank 18, is guided to the drying section 50, the moisture on the surfaces thereof is squeezed off by the squeeze rollers 42.

A crossover rack whose structure is similar to the crossover rack 34, which is disposed between the developing tank 14 and the fixing tank 16, and the crossover rack 34, which is disposed between the fixing tank 16 and the washing tank 18, can be used at a portion where the squeeze rollers 42 and the guides 43 are provided near the washing tank 18.

Figure 2:
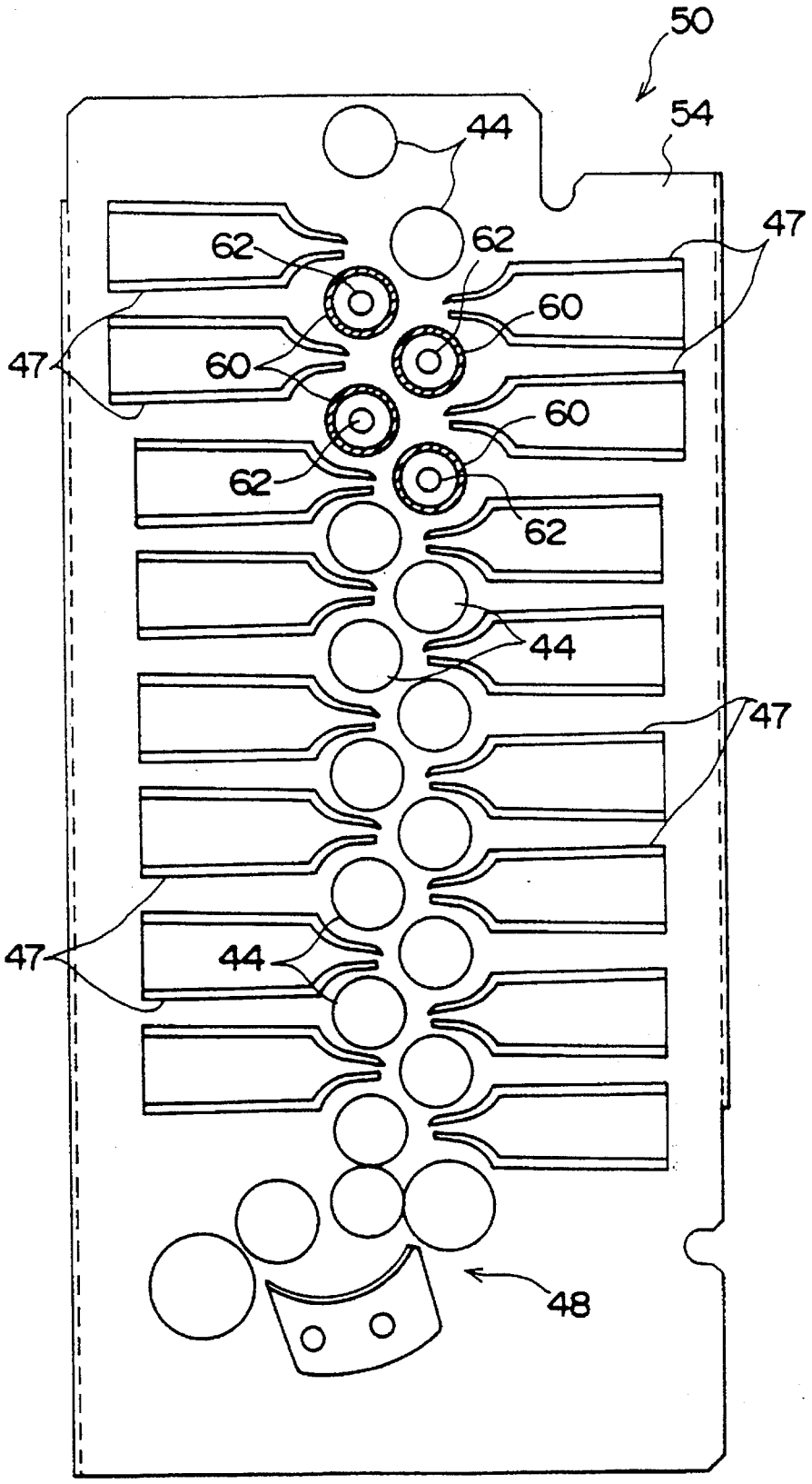
FIG. 2 is a front view illustrating an arrangement of rollers and heat rollers in a drying section.

In the drying section 50, as illustrated in FIG. 2, conveying rollers 44 and heat rollers 60, which are suspended between a pair of side plates 54 disposed in parallel with each other, are staggered so as to form a conveying path for the film 20. There are also blow pipes 47 in the drying section 50, which blow drying air, sent by a drying air supplying portion 45 which includes a heater 90 and a drying fan 92 (see FIG. 3), into the conveying path of the film 20. The blow pipes 47 are independently disposed between the respective conveying rollers 44 and the heat rollers 60. A chamber 49 (see FIG. 1), to which drying air from the drying air supplying portion 45 is supplied, is provided at a longitudinal end portion of these blow pipes 47.

Namely, the drying air generated by the heater 90 and the drying fan 92 is uniformly pressurized by being temporarily stored in the chamber 49. Thereafter, the drying air is guided to the respective blow pipes 47 and is blown out through the blow ports of the blow pipes 47.

The order for arranging the conveying rollers 44 and the heat rollers 60 within the drying section 50 is as follows. First, from the upper portion of the drying section 50, there are two conveying rollers 44, followed by four heat rollers 60, and thereafter, ten conveying rollers 44. As described above, the conveying rollers 44 and the heat rollers 60 are staggered. The film 20, both surfaces of which make contact with the rollers 44 and 60, is conveyed downward by the conveying force of the same. At the same time, the film 20 is heated and dried by the drying air which is blown out from the blow pipes 47.

The heat roller 60 is structured so that a halogen lamp 62 is disposed along a rotating shaft of the heat roller 60 and is in a cavity within a pipe made of a metal such as aluminum. The surface of the heat roller 60 is heated by the light from the halogen lamp 62.

A drying/turning portion 48 is disposed at a lower portion of the drying section 50. The film 20, which is conveyed downwardly and dried by the heat rollers 60 and the drying air, is turned diagonally upward by the drying/turning portion 48. The film 20 is thereafter stocked in a receiving box 52.

Figure 3:
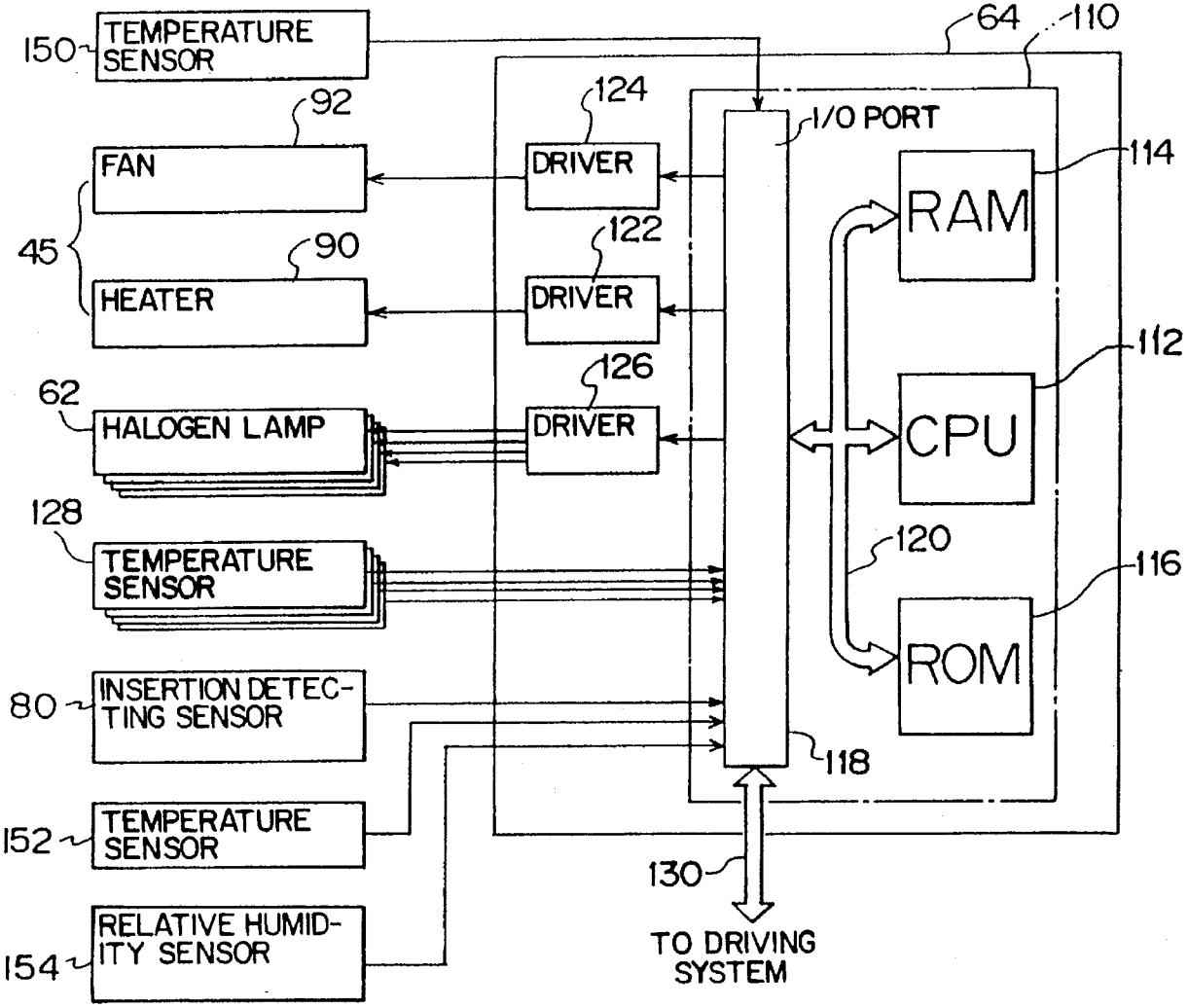
FIG. 3 is a control block diagram relating to the present embodiment.

As shown in FIG. 3, a control unit 64 is formed so as to include a microcomputer 110. The microcomputer 110 is comprised of a CPU 112, a RAM 114, a ROM 116, an input/output port 118 and buses 120 such as a data bus, a controller bus and the like which connect them.

The heater 90 and the fan 92 of the aforementioned drying air supplying portion 45 are connected to the input/output port 118 via drivers 122 and 124. In addition, the four halogen lamps 62 are respectively connected to the input/output port 118 via a driver 126.

In addition, a temperature sensor 128, which detects temperatures of the peripheral surfaces of the heat rollers 60 accommodating the respective halogen lamps 62, a temperature sensor 150, which detects a temperature of the drying air supplied from the drying air supplying portion 45, and an insertion detecting sensor 80 are connected to the input/output port 118.

Further, a temperature sensor 152, which detects the temperature of the environment in which the automatic developing apparatus 10 is set, and a relative humidity sensor 154, which detects relative humidity, are connected to the input/output port 118. In the CPU 112, environmental absolute humidity Zk of the environment, in which the automatic developing apparatus 10 is set, is calculated. A sensor, which directly detects absolute humidity, may be provided.

Further, a signal line 130, which controls the driving system of the respective tanks and the drying section 50, is connected to the input/output port 118.

The optimal temperatures of the heat-contacting device and warm air are decided at the temperatures whose differences from the surface temperature of the film 20 are assumed to be constant. Namely, the degree to which the film 20 is dried by contacting the heat rollers 60 and the other rollers 44 is determined by the difference between an average value of the surface temperatures of the heat rollers 60 and the other rollers 44 (hereinafter, "average surface temperature of line of rollers") and the surface temperature of the film 20 (the surface temperatures of the other rollers 44 are heated by discharged heat from the heat rollers 60 and drying air). On the other hand, the degree to which the film 20 is dried by the blowing of the drying air, is determined by the difference between the temperature of the drying air and the surface temperature of the film 20.

If these degrees are irrespectively set and the film 20 is dried, the film 20 becomes overdried in a case in which the surface temperature of the heat rollers 60 is high. In a case in which the temperature of the hot air is high, peripheral components of the film 20 are adversely effected.

Accordingly, the relative percentage in which the average surface temperature of the line of rollers and the temperature of the drying air contribute to the drying of the film 20 is determined, and the temperatures of the heat rollers 60 and the hot air are prevented from being set higher than necessary.

Namely, in the present embodiment, the relative contribution of the drying air to the film 20 and that of the line of rollers to the film 20 are determined. The optimal values at 45-second processing and 30-second processing are determined in Table 3 below. Here, "45-second processing" and "30-second processing" mean that, in the automatic developing apparatus shown in FIG. 1, the amount of time from the detection of the film 20 by the sensor 80 to the delivery of the film into the receiving box 52 is 45 seconds and 30 seconds, respectively. Usually, the processing time can be changed by changing the conveying speed in the developing apparatus. Here, it is assumed that $T_W$ is a drying air temperature, $T_{AV}$ is an average surface temperature of the line of rollers, and $T_F$ is a surface temperature of the film 20. By adding the relative contributions of both (drying by the drying air and drying by the heat rollers), the drying contribution percentage to the film 20 becomes 1 (100%).

TABLE 1

| | 45-SECOND PROCESSING | 30-SECOND PROCESSING |
|---|---|---|
| $T_w-T_F$ | 33° C. | 32° C. |
| $T_{AV}-T_F$ | 18° C. | 25° C. |

In a processing apparatus which includes a drying section, the values in Tables 2 and 3 were determined by experimentation such that the relationships between $T_W$ and $T_{AV}$ in Table 1 are maintained.

Here, the RAM 114 stores maps or tables as illustrated in Tables 2 and 3 which set the surface temperatures of the heat rollers 60 and the temperature of the drying air in accordance with a processing time of the film 20 (i.e., a total processing time which includes processing by processing solutions and drying processing). When Tables 2 and 3 were made, wind velocity of the drying air is assumed to be 12 to 14 meters per second.

In the Tables 2 and 3, regardless of the changes in the environmental absolute humidity and the amount of processing the film 20, a warm air temperature $T_W$ and a surface temperature $T_{HR}$ of the heat rollers 60 are determined by experimentation so that the temperatures shown in Table 1 are always obtained. The surface temperature $T_{HR}$ of the heat rollers 60 can be easily determined by converting the average surface temperature $T_{AV}$ of the line of rollers.

Accordingly, regardless of the environmental absolute humidity and the processed amount of the film 20, the relative contributions to the film 20 are always constant and the temperatures are optimally set.

TABLE 2

| 45-SECOND PROCESSING | | | | | | | | |
|---|---|---|---|---|---|---|---|---|
| | (S) | | | | | | | |
| (Zk) | $S \leqq 0.5$ | $0.5 < S \leqq 1$ | $1 < S \leqq 1.5$ | $1.5 < S \leqq 2$ | $2 < S \leqq 2.5$ | $2.5 < S \leqq 3$ | $3 < S \leqq 3.5$ | $3.5 < S \leqq 4$ |
| $Z_K \leqq 1.6$[g/Kg] | 44 | 45 | ← | 46 | 47 | ← | 48 | 49 |
| | 41 | 43 | ← | 44 | 46 | ← | 48 | 49 |
| $1.6 < Z_K \leqq 2.6$ | 45 | 46 | ← | 47 | 48 | ← | 49 | ← |
| | 42 | 44 | ← | 45 | 47 | ← | 48 | 49 |
| $2.6 < Z_K \leqq 3.7$ | 46 | 47 | ← | 48 | 49 | ← | 50 | ← |
| | 43 | 45 | ← | 46 | 48 | ← | 49 | 50 |
| $3.7 < Z_k \leqq 4.8$ | 47 | 48 | ← | 49 | ← | 50 | ← | 51 |

TABLE 2-continued

45-SECOND PROCESSING

| | | | | | | | | |
|---|---|---|---|---|---|---|---|---|
| | 44 | 46 | ← | 47 | 48 | 49 | ← | 51 |
| $4.8 < Z_K \leqq 5.9$ | 48 | 49 | ← | 50 | ← | 51 | ← | 52 |
| | 45 | 47 | ← | 48 | 49 | 50 | ← | 52 |
| $5.9 < Z_K \leqq 7.1$ | 49 | 50 | ← | 51 | ← | 52 | ← | 53 |
| | 46 | 48 | ← | 49 | 50 | 51 | ← | 53 |
| $7.1 < Z_K \leqq 8.3$ | 50 | ← | 51 | ← | 52 | ← | 53 | ← |
| | 47 | 48 | 49 | ← | 51 | ← | 52 | 53 |
| $8.3 < Z_K \leqq 9.7$ | 51 | ← | 52 | ← | 53 | ← | 54 | ← |
| | 48 | 49 | 50 | ← | 52 | ← | 53 | 54 |
| $9.7 < Z_K \leqq 11.1$ | 52 | ← | 53 | ← | 54 | ← | 55 | ← |
| | 49 | 50 | 51 | ← | 53 | ← | 54 | 55 |
| $11.1 < Z_k \leqq 12.6$ | 53 | ← | 54 | ← | 55 | ← | ← | 56 |
| | 50 | 51 | 52 | ← | 54 | ← | ← | 56 |
| $12.6 < Z_K \leqq 14.2$ | 54 | ← | 55 | ← | 56 | ← | ← | 57 |
| | 51 | 52 | 53 | ← | 55 | ← | ← | 57 |
| $14.2 < Z_K \leqq 15.9$ | 55 | ← | 56 | ← | ← | 57 | ← | 58 |
| | 52 | 53 | 54 | ← | 55 | 56 | ← | 57 |
| $15.9 < Z_K \leqq 17.6$ | 56 | ← | 57 | ← | ← | 58 | ← | ← |
| | 53 | 54 | 55 | ← | 56 | 57 | ← | 58 |
| $17.6 < Z_K$ | 57 | ← | 58 | ← | ← | 59 | ← | ← |
| | 54 | 55 | 56 | ← | 57 | 58 | ← | 59 |

| | (S) | | | | | |
|---|---|---|---|---|---|---|
| (Zk) | $4 < S \leqq 3.5$ | $4.5 < S \leqq 5$ | $5 < S \leqq 5.5$ | $5.5 < S \leqq 6$ | $6 < S \leqq 6.5$ | $6.5 < S$ |
| $Z_K \leqq 1.6$[g/Kg] | ← | 50 | ← | 51 | ← | 52 |
| | ← | 50 | ← | 52 | ← | 53 |
| $1.6 < Z_K \leqq 2.6$ | 50 | ← | 51 | ← | 52 | ← |
| | 50 | ← | 51 | 52 | 53 | ← |
| $2.6 < Z_K \leqq 3.7$ | 51 | ← | 52 | ← | 53 | ← |
| | 51 | ← | 52 | 53 | 54 | ← |
| $3.7 < Z_k \leqq 4.8$ | ← | 52 | ← | 53 | ← | 54 |
| | ← | 52 | ← | 54 | ← | 55 |
| $4.8 < Z_K \leqq 5.9$ | ← | 53 | ← | 54 | ← | ← |
| | ← | 53 | ← | 55 | ← | ← |
| $5.9 < Z_K \leqq 7.1$ | ← | ← | 54 | ← | 55 | ← |
| | ← | ← | 54 | 55 | 56 | ← |
| $7.1 < Z_K \leqq 8.3$ | 54 | ← | 55 | ← | ← | 56 |
| | 54 | ← | 55 | 56 | ← | 57 |
| $8.3 < Z_K \leqq 9.7$ | 55 | ← | ← | 56 | ← | 57 |
| | 55 | ← | ← | 57 | ← | 58 |
| $9.7 < Z_K \leqq 11.1$ | ← | 56 | ← | 57 | ← | ← |
| | ← | 56 | ← | 58 | ← | ← |
| $11.1 < Z_k \leqq 12.6$ | ← | 57 | ← | ← | 58 | ← |
| | ← | 57 | ← | 58 | 59 | ← |
| $12.6 < Z_K \leqq 14.2$ | ← | ← | 58 | ← | ← | 59 |
| | ← | ← | 58 | 59 | ← | 60 |
| $14.2 < Z_K \leqq 15.9$ | ← | ← | 59 | ← | ← | ← |
| | ← | ← | 59 | 60 | ← | ← |
| $15.9 < Z_K \leqq 17.6$ | 59 | ← | ← | 60 | ← | ← |
| | 59 | ← | ← | 61 | ← | ← |
| $17.6 < Z_K$ | ← | 60 | ← | ← | 61 | ← |
| | ← | 60 | ← | 61 | 62 | ← |

Note:
UPPER ROW: SETTING OF WARM AIR
LOWER ROW: SETTING OF HEAT ROLLERS
ZK: ENVIRONMENTAL ABSOLUTE HUMIDITY
S: PROCESSED AMOUNT PER UNIT OF TIME (FOR A 10 INCH × 12 INCH SHEET: PROCESSING FOR 30 SECONDS)

TABLE 3

30-SECOND PROCESSING

| | (S) | | | | | | | |
|---|---|---|---|---|---|---|---|---|
| (Zk) | $S \leqq 0.5$ | $0.5 < S \leqq 1$ | $1 < S \leqq 1.5$ | $1.5 < S \leqq 2$ | $2 < S \leqq 2.5$ | $2.5 < S \leqq 3$ | $3 < S \leqq 3.5$ | $3.5 < S \leqq 4$ |
| $Z_K \leqq 1.6$[g/Kg] | 43 | 44 | ← | 45 | ← | 46 | ← | 47 |
| | 69 | 71 | ← | 72 | 73 | 74 | ← | 76 |
| $1.6 < Z_K \leqq 2.6$ | 44 | 45 | ← | 46 | ← | 47 | ← | 48 |
| | 70 | 72 | ← | 73 | 74 | 75 | ← | 77 |
| $2.6 < Z_K \leqq 3.7$ | 45 | 46 | ← | 47 | ← | 48 | ← | 49 |
| | 71 | 73 | ← | 74 | 75 | 76 | ← | 78 |
| $3.7 < Z_k \leqq 4.8$ | 46 | 47 | ← | 48 | ← | ← | 49 | ← |

TABLE 3-continued

30-SECOND PROCESSING

| | | | | | | | | |
|---|---|---|---|---|---|---|---|---|
| | 72 | 74 | ← | 75 | 76 | ← | 77 | 78 |
| $4.8 < Z_K \leqq 5.9$ | 47 | ← | 48 | ← | 49 | ← | 50 | ← |
| | 73 | 74 | 75 | ← | 77 | ← | 78 | 79 |
| $5.9 < Z_K \leqq 7.1$ | 48 | ← | 49 | ← | 50 | ← | 51 | ← |
| | 74 | 75 | 76 | ← | 78 | ← | 79 | 80 |
| $7.1 < Z_K \leqq 8.3$ | 49 | ← | 50 | ← | ← | 51 | ← | 52 |
| | 75 | 76 | 77 | ← | 78 | 79 | ← | 81 |
| $8.3 < Z_K \leqq 9.7$ | 50 | ← | 51 | ← | ← | 52 | ← | 53 |
| | 76 | 77 | 78 | ← | 79 | 80 | ← | 82 |
| $9.7 < Z_K \leqq 11.1$ | 51 | ← | 52 | ← | ← | 53 | ← | ← |
| | 77 | 78 | 79 | ← | 80 | 81 | ← | 82 |
| $11.1 < Z_k \leqq 12.6$ | 52 | ← | 53 | ← | ← | 54 | ← | ← |
| | 78 | 79 | 80 | ← | 81 | 82 | ← | 83 |
| $12.6 < Z_K \leqq 14.2$ | 53 | ← | 54 | ← | ← | 55 | ← | ← |
| | 79 | 80 | 81 | ← | 82 | 83 | ← | 84 |
| $14.2 < Z_K \leqq 15.9$ | 54 | ← | 55 | ← | ← | ← | 56 | ← |
| | 80 | 81 | 82 | ← | 83 | ← | 84 | 85 |
| $15.9 < Z_K \leqq 17.6$ | 55 | ← | ← | 56 | ← | ← | 57 | ← |
| | 81 | 82 | ← | 83 | 84 | ← | 85 | 86 |
| $17.6 < Z_K$ | 56 | ← | ← | 57 | ← | ← | ← | 58 |
| | 82 | 83 | ← | 84 | 85 | ← | ← | 87 |

| | (S) | | | | | | |
|---|---|---|---|---|---|---|---|
| (Zk) | $4 < S \leqq 3.5$ | $4.5 < S \leqq 5$ | $5 < S \leqq 5.5$ | $5.5 < S \leqq 6$ | $6 < S \leqq 6.5$ | $6.5 < S \leqq 7$ | $7 < S \leqq 7.5$ |
| $Z_k \leqq 1.6$[g/Kg] | ← | 48 | ← | 49 | ← | 50 | ← |
| | ← | 77 | ← | 79 | ← | 80 | ← |
| $1.6 < Z_K \leqq 2.6$ | ← | 49 | ← | ← | 50 | ← | 51 |
| | ← | 78 | ← | 79 | 80 | ← | 81 |
| $2.6 < Z_K \leqq 3.7$ | ← | ← | 50 | ← | 51 | ← | ← |
| | ← | ← | 79 | 80 | 81 | ← | ← |
| $3.7 < Z_k \leqq 4.8$ | 50 | ← | 51 | ← | ← | 52 | ← |
| | 79 | ← | 80 | 81 | ← | 82 | ← |
| $4.8 < Z_K \leqq 5.9$ | 51 | ← | ← | 52 | ← | ← | 53 |
| | 80 | ← | ← | 82 | ← | ← | 83 |
| $5.9 < Z_K \leqq 7.1$ | ← | 52 | ← | ← | 53 | ← | ← |
| | ← | 81 | ← | 82 | 83 | ← | ← |
| $7.1 < Z_K \leqq 8.3$ | ← | ← | 53 | ← | ← | 54 | ← |
| | ← | ← | 82 | 83 | ← | 84 | ← |
| $8.3 < Z_K \leqq 9.7$ | ← | ← | 54 | ← | ← | 55 | ← |
| | ← | ← | 83 | 84 | ← | 85 | ← |
| $9.7 < Z_K \leqq 11.1$ | 54 | ← | ← | 55 | ← | ← | 56 |
| | 83 | ← | ← | 85 | ← | ← | 86 |
| $11.1 < Z_k \leqq 12.6$ | 55 | ← | ← | 56 | ← | ← | ← |
| | 84 | ← | ← | 86 | ← | ← | ← |
| $12.6 < Z_K \leqq 14.2$ | 56 | ← | ← | ← | 57 | ← | ← |
| | 85 | ← | ← | 86 | 87 | ← | ← |
| $14.2 < Z_K \leqq 15.9$ | ← | 57 | ← | ← | ← | 58 | ← |
| | ← | 86 | ← | 87 | ← | 88 | ← |
| $15.9 < Z_K \leqq 17.6$ | ← | ← | 58 | ← | ← | 59 | ← |
| | ← | ← | 87 | 88 | ← | 89 | ← |
| $17.6 < Z_K$ | ← | ← | 59 | ← | ← | ← | 60 |
| | ← | ← | 88 | 89 | ← | ← | 90 |

| | (S) | | | | |
|---|---|---|---|---|---|
| (Zk) | $7.5 < S \leqq 8$ | $8 < S \leqq 8.5$ | $8.5 < S \leqq 9$ | $9 < S \leqq 9.5$ | $9.5 < S$ |
| $Z_K \leqq 1.6$[g/Kg] | ← | 51 | ← | 52 | ← |
| | ← | 81 | ← | 82 | ← |
| $1.6 < Z_K \leqq 2.6$ | ← | ← | 52 | ← | 53 |
| | ← | ← | 82 | ← | 83 |
| $2.6 < Z_K \leqq 3.7$ | 52 | ← | ← | 53 | ← |
| | 82 | ← | ← | 83 | ← |
| $3.7 < Z_k \leqq 4.8$ | ← | 53 | ← | ← | 54 |
| | ← | 83 | ← | ← | 84 |
| $4.8 < Z_K \leqq 5.9$ | ← | ← | 54 | ← | ← |
| | ← | ← | 84 | ← | ← |
| $5.9 < Z_K \leqq 7.1$ | 54 | ← | ← | 55 | ← |
| | 84 | ← | ← | 85 | ← |
| $7.1 < Z_K \leqq 8.3$ | ← | 55 | ← | ← | 56 |
| | ← | 85 | ← | ← | 86 |
| $8.3 < Z_K \leqq 9.7$ | ← | 56 | ← | ← | ← |
| | ← | 86 | ← | ← | ← |
| $9.7 < Z_K \leqq 11.1$ | ← | ← | 57 | ← | ← |
| | ← | ← | 87 | ← | ← |

TABLE 3-continued

| 30-SECOND PROCESSING | | | | | |
|---|---|---|---|---|---|
| $11.1 < Z_k \leqq 12.6$ | 57 | ← | ← | 58 | ← |
| | 87 | ← | ← | 88 | ← |
| $12.6 < Z_K \leqq 14.2$ | ← | 58 | ← | ← | 59 |
| | ← | 88 | ← | ← | 89 |
| $14.2 < Z_K \leqq 15.9$ | ← | 59 | ← | ← | ← |
| | ← | 89 | ← | ← | ← |
| $15.9 < Z_K \leqq 17.6$ | ← | ← | ← | 60 | ← |
| | ← | ← | ← | 90 | ← |
| $17.6 < Z_K$ | ← | ← | ← | ← | 61 |
| | ← | ← | ← | ← | 91 |

Note:
UPPER ROW: SETTING OF WARM AIR
LOWER ROW: SETTING OF HEAT ROLLERS
ZK: ENVIRONMENTAL ABSOLUTE HUMIDITY
S: PROCESSED AMOUNT PER UNIT OF TIME (FOR A 10 INCH × 12 INCH SHEET; PROCESSING FOR 30 SECONDS)

The optimal temperatures obtained by advance experimentation can be obtained from these maps provided that environmental absolute humidity at the time of drying and an amount of the film 20 which is processed per unit of time are obtained.

The operation of the present embodiment will be explained hereinbelow.

The film 20, onto which images have been recorded by exposure, is inserted into the automatic developing apparatus 10 through the insertion opening 15 so as to be processed. In the automatic developing apparatus 10, the film 20, which was inserted through the insertion opening 15, is drawn into the automatic developing apparatus 10 by the insertion rack 17 so that the film 20 is delivered into the developing tank 14 of the processing solution processing section 11.

In the developing tank 14, the film 20 is immersed in the developing solution while being conveyed by the conveying rollers 22 of the rack 24 in a substantially U-shape so as to be subjected to developing processing. The film 20, which has undergone processing in the developing tank 14, is guided and conveyed by the guides 38 and the conveying rollers 36 of the crossover rack 34 so as to be delivered into the fixing tank 16. In the fixing tank 16, the film 20 is conveyed and guided by the conveying rollers 26 of the rack 28 in a substantially U-shape. Thereafter, the film 20 is immersed in the fixing solution so as to be subjected to fixing processing. The film 20, which has undergone processing in the fixing tank 16, is guided and conveyed by the guides 38 and the conveying rollers 36 of the crossover rack 34 so as to be delivered into the washing tank 18. In the washing tank 18, the film 20 is conveyed by the conveying rollers 30 of the rack 32 so as to be immersed in the washing water. There, the film 20 is subjected to water washing so as to remove components of the fixing solution from the surfaces of the film 20.

The film 20, which has undergone washing processing, is guided and conveyed from the washing tank 18 by the squeeze rollers 42 and the guides 43 of the squeeze rack 40. Thereafter, the film 20 is delivered from the processing solution processing section 11 into the drying section 50. At this time, the moisture adhered to the surfaces of the film 20 is removed by the squeeze rollers 42.

First, in the drying section 50, the film 20 is conveyed while both surfaces thereof alternately contacting the two conveying rollers 44, and at the same time drying air is blown onto the film 20. Thus, water spots, which were not squeezed off by the aforementioned squeeze rollers 42 and which remain in particular on the leading and the rear end portions of the film 20 in the conveying direction thereof, and which remain uneven over the entire film 20, and can be made comparatively uniform.

The film 20, to which the water spots have adhered in a comparatively uniform manner by the above-described conveying rollers 44 and by the drying air, promotes evaporation because both surfaces of the film 20 alternately contact the four heat rollers 60. Thereafter, atmosphere which contains a large amount of moisture is discharged by the drying air from the blow pipes 47, which correspond to the heat rollers 60, so that the evaporation is promoted even further. At this time, because there were no water spots irregularities on the film 20, the evaporation does not partially advance or recede. Accordingly, evaporation is uniformly promoted over the entire film 20.

Thereafter, the drying air generated by the drying air supplying portion 45 is blown onto both surfaces of the film 20 from the blow pipes 47 while the film 20 is being conveyed by the ten conveying rollers 44. Thus, the film 20 is heated and dried. When the film 20 reaches the drying/turning portion 48 after it is conveyed while being heated, the film 20 is turned diagonally upward so as to be discharged. The film 20 is then stocked in the receiving box 49.

Figure 4:
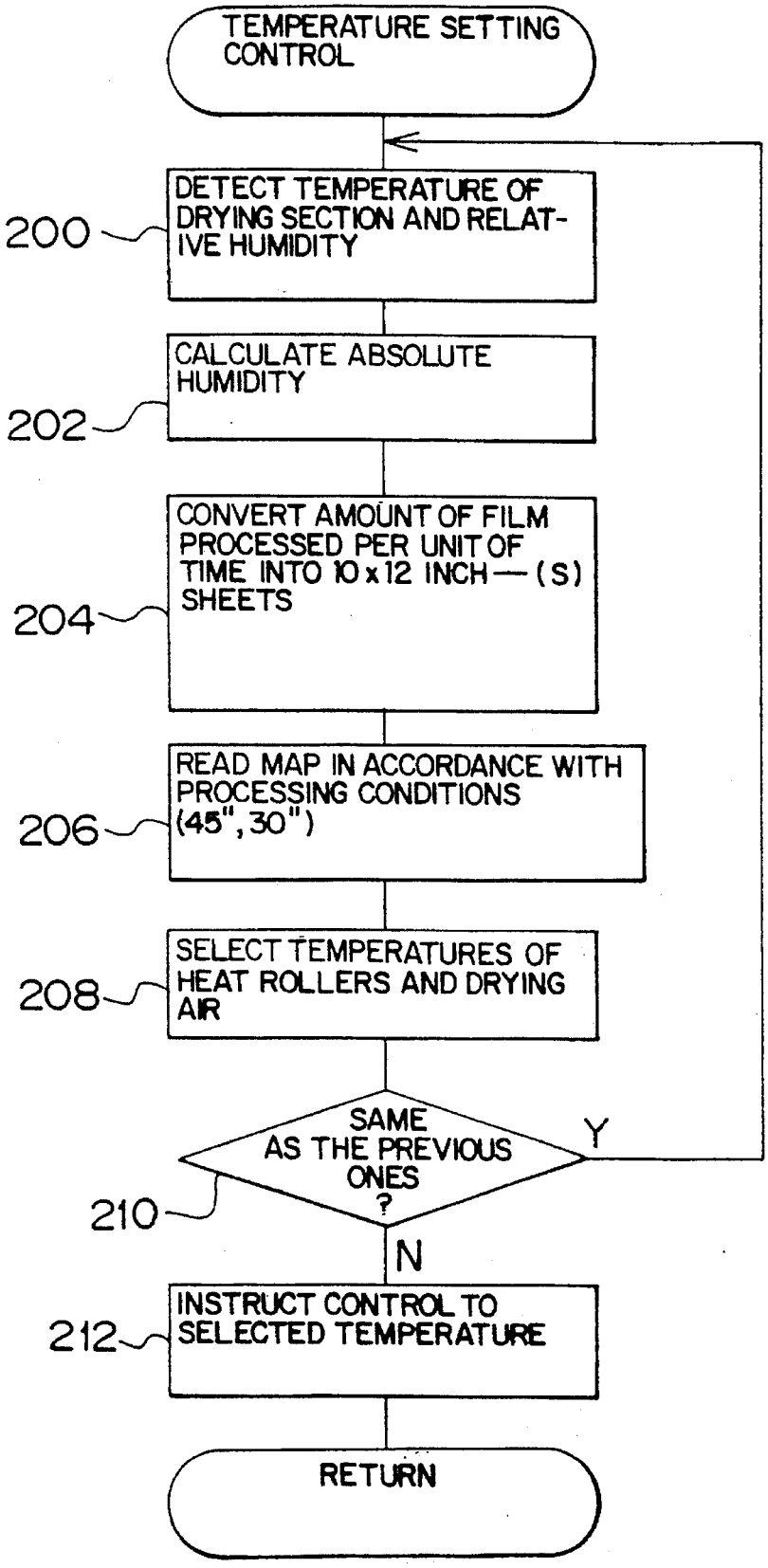
FIG. 4 is a control flowchart illustrating a temperature control setting routine.

Here, the surface temperature of the heat rollers 60 and the temperature of the drying air in the drying section 50 of the present embodiment are set according to the environmental absolute humidity and the amount of film 20 to be processed. Temperature control of the surface of the heat rollers 60 and the drying air will be explained hereinbelow in accordance with the flowchart in FIG. 4.

In step 200, the temperature of the environment in which the automatic developing apparatus is set and relative humidity of the environment are respectively detected by a temperature sensor 152 and a relative humidity sensor 154. Next, the process proceeds to step 202 where environmental absolute humidity Zk is calculated from the detected temperature and relative humidity.

In subsequent step 204, an insertion detecting sensor 80 calculates a processing area from the time the film 20 has been detected, velocity in which the film 20 has been conveyed and the like. From the result of this calculation, four-cut conversion value S of the amount of the film 20 which is processed per unit of time (hereinafter, the "processed amount S" of the film 20) is obtained.

In subsequent step 206, the map in Table 1 (or Table 2) is read out on the basis of processing conditions (45-second processing or 30-second processing). In the next step 208, the temperature $T_{HR}$ of the heat rollers 60 and the temperature $T_W$ of the drying air are selected by using the read map and by using the environmental absolute humidity Zk and the processed amount S of the film 20, which have been obtained in steps 202 and 204, as parameters.

Next, in step 210, a determination is made as to whether each of the aforementioned selected temperatures is the same as the previously-selected temperature. If the answer to the determination in step 210 is "Yes", the process returns to step 200. If the answer is "No", the process proceeds to step 212 where a designating signal, which controls the surface temperature of the heat rollers 60 and the temperature of the drying air, for example, by an on/off control, is outputted by using the temperature selected in step 208 as a reference value.

In the temperature control system of the heat rollers 60, which are formed, for example, by a relay circuit or the like, and in the drying air temperature control system, the outputting of the designating signal changes the reference value to the designated temperature and the controls are continued respectively.

Figure 5A:
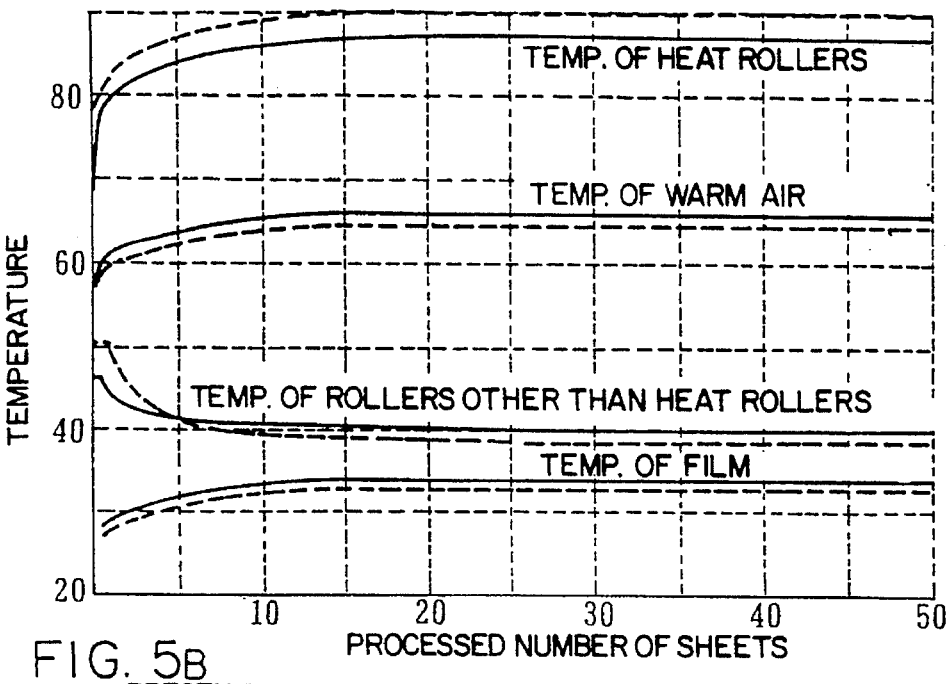
FIGS. 5A, 5B and 5C shows a temperature control characteristics between the present embodiment and the conventional example, and drying evaluation characteristics showing drying levels between the present embodiment and the conventional example and image quality levels between the present embodiment and the conventional example.
Figure 5B:
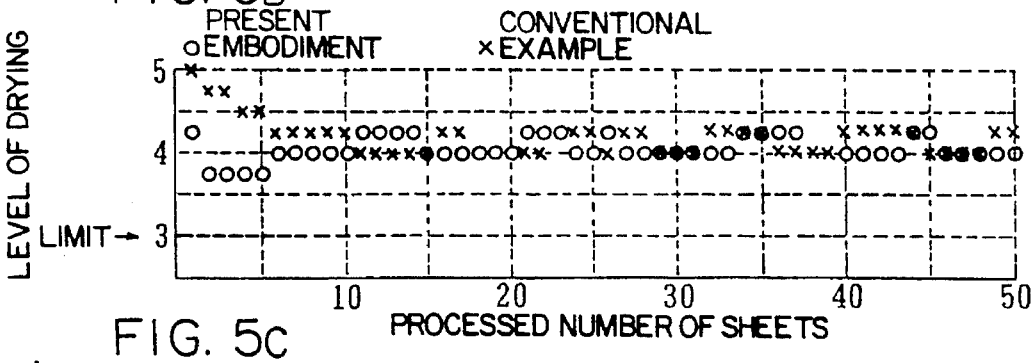
Figure 5C:
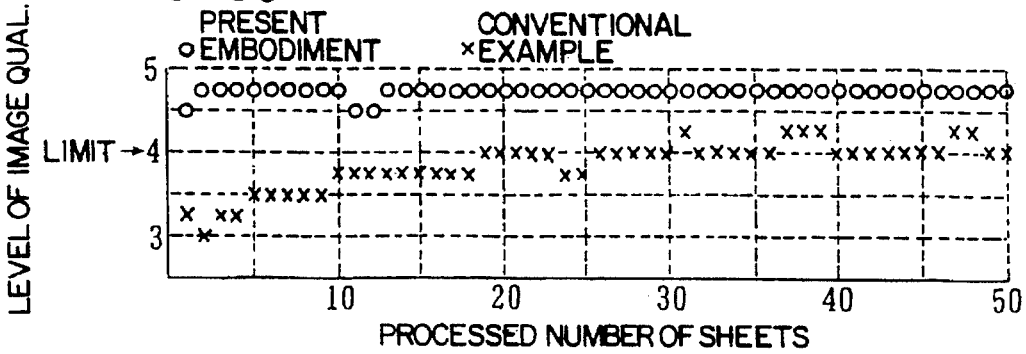

FIGS. 5A–5C show a comparison of the temperature control between the present embodiment and the conventional example. Evaluations of the levels of drying and those of the image quality of the film 20 are illustrated in five stages. Among the levels of drying the film 20, level 5 is the highest and level 3 is the lowest value permissible. Regarding image quality levels of the film 20, level 5 is the highest and level 4 is the lowest value permissible.

As shown in FIGS. 5A–5C, the difference between the average surface temperature of the line of rollers (an average value of characteristics between the temperatures of the heat rollers and the temperatures of rollers other than the heat rollers) and the temperature of the warm air is always kept constant. Accordingly, the image quality levels are found to be extremely improved. Namely, the levels of drying the film 20 (the amount of moisture contained in the film 20) are almost the same as those of the conventional example. However, when the drying by the heat rollers 60 (and the other rollers) and the drying by the drying air are combined, the finished state (the image quality) can be improved because the relative drying contribution is not biased.

In this way, the degree to which the heat rollers 60 (in practice, the entire line of rollers including the heat rollers 60) contribute to drying the film 20 and the degree to which the drying air contributes to drying the film 20 are previously set (the relative contributions are predetermined). Even if there are changes in the environmental absolute humidity and changes in the processed amount per unit of time, the contribution percentages remain unchanged. Therefore, the drying ability can be improved by setting the temperature to the minimum temperature necessary to dry the film 20. Namely, overdrying due to the high contribution percent of the heat rollers 60 can be prevented and unnecessary heat-resistant measures due to the high contribution percent of the drying air can be removed. In addition, consumption of electricity can be reduced because heat is not wasted.

In the present embodiment, the respective temperature settings of the 45-second processing and the 30-second processing are made to change the temperatures as an absolute amount on the basis of Tables 2 and 3. However, as illustrated in Tables 4 and 5, the respective temperatures may be stored as values of the increase or decrease in the reference temperatures (corresponding to environmental absolute humidity Zk is $9.7<Zk\leqq 11.1$ and a processed amount S per unit of time is $S\leqq 0.5$) and calculated by increasing or decreasing the read values from the reference temperatures.

TABLE 4

45-SECOND PROCESSING

| | (S) | | | | | | | |
|---|---|---|---|---|---|---|---|---|
| (Zk) | $S \leqq 0.5$ | $0.5 < S \leqq 1$ | $1 < S \leqq 1.5$ | $1.5 < S \leqq 2$ | $2 < S \leqq 2.5$ | $2.5 < S \leqq 3$ | $3 < S \leqq 3.5$ | $3.5 < S \leqq 4$ |
| $Z_K \leqq 1.6$[g/Kg] | −8 | −7 | ← | −6 | −5 | ← | −4 | −3 |
| | −8 | −6 | ← | −5 | −3 | ← | −2 | 0 |
| $1.6 < Z_K \leqq 2.6$ | −7 | −6 | ← | −5 | −4 | ← | −3 | ← |
| | −7 | −5 | ← | −4 | −2 | ← | −1 | 0 |
| $2.6 < Z_K \leqq 3.7$ | −6 | −5 | ← | −4 | −3 | ← | −2 | ← |
| | −6 | −4 | ← | −3 | −1 | ← | 0 | +1 |
| $3.7 < Z_k \leqq 4.8$ | −5 | −4 | ← | −3 | ← | −2 | ← | −1 |
| | −5 | −3 | ← | −2 | −1 | 0 | ← | +2 |
| $4.8 < Z_K \leqq 5.9$ | −4 | −3 | ← | −2 | ← | −1 | ← | 0 |
| | −4 | −9 | ← | −1 | 0 | +1 | ← | +3 |
| $5.9 < Z_K \leqq 7.1$ | −3 | −2 | ← | −1 | ← | 0 | ← | +1 |
| | −3 | −1 | ← | 0 | +1 | +2 | ← | +4 |
| $7.1 < Z_K \leqq 8.3$ | −2 | ← | −1 | ← | 0 | ← | +1 | ← |
| | −2 | −1 | 0 | ← | +2 | ← | +3 | +4 |
| $8.3 < Z_K \leqq 9.7$ | −1 | ← | 0 | ← | +1 | ← | +2 | ← |
| | −1 | 0 | +1 | ← | +3 | ← | +4 | +5 |
| $9.7 < Z_K \leqq 11.1$ | 0 | ← | +1 | ← | +2 | ← | +3 | ← |
| | 0 | +1 | +2 | ← | +4 | ← | +5 | +6 |
| $11.1 < Z_k \leqq 12.6$ | +1 | ← | +2 | ← | +3 | ← | ← | +4 |
| | +1 | +2 | +3 | ← | +5 | ← | ← | +7 |
| $12.6 < Z_K \leqq 14.2$ | +2 | ← | +3 | ← | +4 | ← | ← | +5 |
| | +2 | +3 | +4 | ← | +6 | ← | ← | +8 |
| $14.2 < Z_K \leqq 15.9$ | +3 | ← | +4 | ← | ← | +5 | ← | +6 |
| | +3 | +4 | +5 | ← | +6 | +7 | ← | +8 |
| $15.9 < Z_K \leqq 17.6$ | +4 | ← | +5 | ← | ← | +6 | ← | ← |
| | +4 | +5 | +6 | ← | +7 | +8 | ← | +9 |
| $17.6 < Z_K$ | +5 | ← | +6 | ← | ← | +7 | ← | ← |
| | +5 | +6 | +7 | ← | +8 | +9 | ← | +10 |

TABLE 4-continued

| 45-SECOND PROCESSING | | | | | | |
|---|---|---|---|---|---|---|
| | (S) | | | | | |
| (Zk) | 4 < S ≦ 3.5 | 4.5 < S ≦ 5 | 5 < S ≦ 5.5 | 5.5 < S ≦ 6 | 6 < S ≦ 6.5 | 6.5 < S |
| $Z_K$ ≦ 1.6[g/Kg] | ← | −2 | ← | −1 | ← | 0 |
| | ← | +1 | ← | +3 | ← | +4 |
| 1.6 < $Z_K$ ≦ 2.6 | −2 | ← | −1 | ← | 0 | ← |
| | +1 | ← | +2 | +3 | +4 | ← |
| 2.6 < $Z_K$ ≦ 3.7 | −1 | ← | 0 | ← | +1 | ← |
| | +2 | ← | +3 | +4 | +5 | ← |
| 3.7 < $Z_k$ ≦ 4.8 | ← | 0 | ← | +1 | ← | +2 |
| | ← | +3 | ← | +5 | ← | +6 |
| 4.8 < $Z_K$ ≦ 5.9 | ← | +1 | ← | +2 | ← | ← |
| | ← | +4 | ← | +6 | ← | ← |
| 5.9 < $Z_K$ ≦ 7.1 | ← | ← | +2 | ← | +3 | ← |
| | ← | ← | +5 | +6 | +7 | ← |
| 7.1 < $Z_K$ ≦ 8.3 | +2 | ← | +3 | ← | ← | +4 |
| | +5 | ← | +6 | +7 | ← | +8 |
| 8.3 < $Z_K$ ≦ 9.7 | +3 | ← | ← | +4 | ← | +5 |
| | +6 | ← | ← | +8 | ← | +9 |
| 9.7 < $Z_K$ ≦ 11.1 | ← | +4 | ← | +5 | ← | ← |
| | ← | +7 | ← | +9 | ← | ← |
| 11.1 < $Z_k$ ≦ 12.6 | ← | +5 | ← | ← | +6 | ← |
| | ← | +8 | ← | +9 | +10 | ← |
| 12.6 < $Z_K$ ≦ 14.2 | ← | ← | +6 | ← | ← | +7 |
| | ← | ← | +9 | +10 | ← | +11 |
| 14.2 < $Z_K$ ≦ 15.9 | ← | ← | +7 | ← | ← | ← |
| | ← | ← | +10 | +11 | ← | ← |
| 15.9 < $Z_K$ ≦ 17.6 | +7 | ← | ← | +8 | ← | ← |
| | +10 | ← | ← | +12 | ← | ← |
| 17.6 < $Z_K$ | ← | +8 | ← | ← | +9 | ← |
| | ← | +11 | ← | +12 | +13 | ← |

Note:
REFERENCE TEMERATURE . . . SETTING OF WARM AIR: 52° C.
SETTING OF HEAT ROLLERS: 49° C.
UPPER ROW: SETTING OF WARM AIR
LOWER ROW: SETTING OF HEAT ROLLERS
ZK: ENVIRONMENTAL ABSOLUTE HUMIDITY
S: PROCESSED AMOUNT PER UNIT OF TIME (FOR A 10 INCH × 12 INCH SHEET; PROCESSING FOR 30 SECONDS)

TABLE 5

| 30-SECOND PROCESSING | | | | | | | | |
|---|---|---|---|---|---|---|---|---|
| | (S) | | | | | | | |
| (Zk) | S ≦ 0.5 | 0.5 < S ≦ 1 | 1 < S ≦ 1.5 | 1.5 < S ≦ 2 | 2 < S ≦ 2.5 | 2.5 < S ≦ 3 | 3 < S ≦ 3.5 | 3.5 < S ≦ 4 |
| $Z_K$ ≦ 1.6[g/Kg] | −8 | −7 | ← | −6 | ← | −5 | ← | −4 |
| | −8 | −6 | ← | −5 | −4 | −3 | ← | −1 |
| 1.6 < $Z_K$ ≦ 2.6 | −7 | −6 | ← | −5 | ← | −4 | ← | −3 |
| | −7 | −5 | ← | −4 | −3 | −2 | ← | 0 |
| 2.6 < $Z_K$ ≦ 3.7 | −6 | −5 | ← | −4 | ← | −3 | ← | −2 |
| | −6 | −4 | ← | −3 | −2 | −1 | ← | +1 |
| 3.7 < $Z_k$ ≦ 4.8 | −5 | −4 | ← | −3 | ← | ← | −2 | ← |
| | −5 | −3 | ← | −2 | −1 | ← | 0 | +1 |
| 4.8 < $Z_K$ ≦ 5.9 | −4 | ← | −3 | ← | −2 | ← | −1 | ← |
| | −4 | −3 | −2 | ← | 0 | ← | +1 | +2 |
| 5.9 < $Z_K$ ≦ 7.1 | −3 | ← | −2 | ← | −1 | ← | 0 | ← |
| | −3 | −2 | −1 | ← | +1 | ← | +2 | +3 |
| 7.1 < $Z_K$ ≦ 8.3 | −2 | ← | −1 | ← | ← | 0 | ← | +1 |
| | −2 | −1 | 0 | ← | +1 | +2 | ← | +4 |
| 8.3 < $Z_K$ ≦ 9.7 | −1 | ← | 0 | ← | ← | +1 | ← | +2 |
| | −1 | 0 | +1 | ← | +2 | +3 | ← | +4 |
| 9.7 < $Z_K$ ≦ 11.1 | 0 | ← | +1 | ← | ← | +2 | ← | ← |
| | 0 | +1 | +2 | ← | +3 | +4 | ← | +5 |
| 11.1 < $Z_k$ ≦ 12.6 | +1 | ← | +2 | ← | ← | +3 | ← | ← |
| | +1 | +2 | +3 | ← | +4 | +5 | ← | +6 |
| 12.6 < $Z_K$ ≦ 14.2 | +2 | ← | +3 | ← | ← | +4 | ← | ← |
| | +2 | +3 | +4 | ← | +5 | +6 | ← | +7 |
| 14.2 < $Z_K$ ≦ 15.9 | +3 | ← | +4 | ← | ← | ← | +5 | ← |
| | +3 | +4 | +5 | ← | +6 | ← | +7 | +8 |
| 15.9 < $Z_K$ ≦ 17.6 | +4 | ← | ← | +5 | ← | ← | +6 | ← |
| | +4 | +5 | ← | +6 | +7 | ← | +8 | +9 |
| 17.6 < $Z_K$ | +5 | ← | ← | +6 | ← | ← | ← | +7 |

TABLE 5-continued

| 30-SECOND PROCESSING | | | | | | | |
|---|---|---|---|---|---|---|---|
| | +5 | +6 | ← | +7 | +8 | ← | ← | +10 |
| | (S) | | | | | | |
| (Zk) | 4 < S ≦ 3.5 | 4.5 < S ≦ 5 | 5 < S ≦ 5.5 | 5.5 < S ≦ 6 | 6 < S ≦ 6.5 | 6.5 < S ≦ 7 | 7 < S ≦ 7.5 |
| $Z_K$ ≦ 1.6[g/Kg] | ← | −3 | ← | −2 | ← | −1 | ← |
| | ← | 0 | ← | +2 | ← | +3 | ← |
| 1.6 < $Z_K$ ≦ 2.6 | ← | −2 | ← | ← | −1 | ← | 0 |
| | ← | +1 | ← | +2 | +3 | ← | +4 |
| 2.6 < $Z_K$ ≦ 3.7 | ← | ← | −1 | ← | 0 | ← | ← |
| | ← | ← | +2 | +3 | +4 | ← | ← |
| 3.7 < $Z_k$ ≦ 4.8 | −1 | ← | 0 | ← | ← | +1 | ← |
| | +2 | ← | +3 | +4 | ← | +5 | ← |
| 4.8 < $Z_K$ ≦ 5.9 | 0 | ← | ← | +1 | ← | ← | +2 |
| | +3 | ← | ← | +5 | ← | ← | +6 |
| 5.9 < $Z_K$ ≦ 7.1 | ← | +1 | ← | ← | +2 | ← | ← |
| | ← | +4 | ← | +5 | +6 | ← | ← |
| 7.1 < $Z_K$ ≦ 8.3 | ← | ← | +2 | ← | ← | +3 | ← |
| | ← | ← | +5 | +6 | ← | +7 | ← |
| 8.3 < $Z_K$ ≦ 9.7 | ← | ← | +3 | ← | ← | +4 | ← |
| | ← | ← | +6 | +7 | ← | +8 | ← |
| 9.7 < $Z_K$ ≦ 11.1 | +3 | ← | ← | +4 | ← | ← | +5 |
| | +6 | ← | ← | +8 | ← | ← | +9 |
| 11.1 < $Z_k$ ≦ 12.6 | +4 | ← | ← | +5 | ← | ← | ← |
| | +7 | ← | ← | +9 | ← | ← | ← |
| 12.6 < $Z_K$ ≦ 14.2 | +5 | ← | ← | ← | +6 | ← | ← |
| | +8 | ← | ← | +9 | +10 | ← | ← |
| 14.2 < $Z_K$ ≦ 15.9 | ← | +6 | ← | ← | ← | +7 | ← |
| | ← | +9 | ← | +10 | ← | +11 | ← |
| 15.9 < $Z_K$ ≦ 17.6 | ← | ← | +7 | ← | ← | +8 | ← |
| | ← | ← | +10 | +11 | ← | +12 | |
| 17.6 < $Z_K$ | ← | ← | +8 | ← | ← | ← | +9 |
| | ← | ← | +11 | +12 | ← | ← | +13 |

| (Zk) | 7.5 < S ≦ 8 | 8 < S ≦ 8.5 | 8.5 < S ≦ 9 | 9 < S ≦ 9.5 | 9.5 < S |
|---|---|---|---|---|---|
| $Z_K$ ≦ 1.6[g/Kg] | ← | 0 | ← | +1 | ← |
| | ← | +4 | ← | +5 | ← |
| 1.6 < $Z_K$ ≦ 2.6 | ← | ← | +1 | ← | +2 |
| | ← | ← | +5 | ← | +6 |
| 2.6 < $Z_K$ ≦ 3.7 | +1 | ← | ← | +2 | ← |
| | +5 | ← | ← | +6 | ← |
| 3.7 < $Z_k$ ≦ 4.8 | ← | +2 | ← | ← | +3 |
| | ← | +6 | ← | ← | +7 |
| 4.8 < $Z_K$ ≦ 5.9 | ← | ← | +3 | ← | ← |
| | ← | ← | +7 | ← | ← |
| 5.9 < $Z_K$ ≦ 7.1 | +3 | ← | ← | +4 | ← |
| | +7 | ← | ← | +8 | ← |
| 7.1 < $Z_K$ ≦ 8.3 | ← | +4 | ← | ← | +5 |
| | ← | +8 | ← | ← | +9 |
| 8.3 < $Z_K$ ≦ 9.7 | ← | +5 | ← | ← | ← |
| | ← | +9 | ← | ← | ← |
| 9.7 < $Z_K$ ≦ 11.1 | ← | ← | +6 | ← | ← |
| | ← | ← | +10 | ← | ← |
| 11.1 < $Z_k$ ≦ 12.6 | +6 | ← | ← | +7 | ← |
| | +10 | ← | ← | +11 | ← |
| 12.6 < $Z_K$ ≦ 14.2 | ← | +7 | ← | ← | +8 |
| | ← | +11 | ← | ← | +12 |
| 14.2 < $Z_K$ ≦ 15.9 | ← | +8 | ← | ← | ← |
| | ← | +12 | ← | ← | ← |
| 15.9 < $Z_K$ ≦ 17.6 | ← | ← | ← | +9 | ← |
| | ← | ← | ← | +13 | ← |
| 17.6 < $Z_K$ | ← | ← | ← | ← | +10 |
| | ← | ← | ← | ← | +14 |

Note:
REFERENCE TEMERATURE . . . SETTING OF WARM AIR: 51° C.
SETTING OF HEAT ROLLERS: 77° C.
UPPER ROW: SETTING OF WARM AIR
LOWER ROW: SETTING OF HEAT ROLLERS
ZK: ENVIRONMENTAL ABSOLUTE HUMIDITY
S: PROCESSED AMOUNT PER UNIT OF TIME (FOR A 10 INCH × 12 INCH SHEET; PROCESSING FOR 30 SECONDS)

Further, in the present embodiment, the temperature sensor 152 and the relative humidity sensor 154 are disposed outside the automatic developing apparatus 10. The environmental absolute humidity is obtained from the detected results, and the optimum temperature is selected from the map as one of the parameters to obtain the surface temperatures of the heat rollers 60 and the temperature of the drying air. As a condition to reflect the relative contribution to the map, the value (see Table 1) is assumed to be the surface temperature of the film 20 subtracted from the average surface temperature of the line of the rollers or the temperature of the drying air. Accordingly, the average surface temperature of the line of rollers and the temperature of the drying air may be obtained by directly detecting the surface temperature of the film 20 and by adding the constant temperature difference (inverse operation).

As a sensor which detects the surface temperature of the film 20, a contact-type sensor such as thermocouple or the like can be used. However, a non-contact-type sensor using infrared rays or the like is more preferable because a drawback such as damaging the surfaces of the film 20 does not occur. Further, it is most preferable to set the sensor along the conveying path immediately before the drying section 50. However, the sensor may be set after washing processing has finished.

In this case, the obtained temperatures must be corrected in accordance with the amount of the film 20 which is processed per unit of time.

What is claimed is:

1. A method of controlling drying of a photographic material wherein after a photosensitive material is processed by processing solutions, heating the resulting photographic material by a contact-heating device, and blowing warm air onto said photographic material, further comprising the step of:

controlling the temperatures of said contact-heating device and the warm air so that relative contributions of drying of said photographic material by said contact-heating device and the warm air are always constant.

2. A method of controlling drying of a photographic material wherein after a photosensitive material is processed by processing solutions, heating the resulting photographic material mainly by contacting a plurality of rollers including at least one heat roller, and blowing warm air onto said photographic material, further comprising the step of:

setting average surface temperatures of the rollers, which contact the photographic material and which include said heat roller, and the temperature of said warm air so that both the difference between the average surface temperatures of the rollers and the surface temperature of said photographic material, and the difference between the temperature of the warm air and the surface temperature of said photographic material, are kept constant.

3. A method of controlling drying of a photographic material according to claim 2, wherein said temperatures which have been set are corrected on the basis of the amount of the photographic material which is dried per unit of time.

4. A method of controlling drying of a photographic material wherein after a photosensitive material is processed by processing solutions, heating the resulting photographic material mainly by contacting a plurality of rollers including at least one heat roller, and finishing drying by blowing warm air onto said photographic material, further comprising the steps of:

obtaining environmental absolute humidity and the amount of the photographic material which is dried per unit of time by one of detection and calculation; and setting the average surface temperature of the rollers including said heat roller and the temperature of the warm air on the basis of the environmental absolute humidity and the amount of the photographic material which is dried per unit of time so that relative contributions of drying of said photographic material by said rollers and the warm air are always constant.

5. A method of controlling drying of a photographic material according to claim 4, wherein said amount of photographic material which is dried per unit of time is obtained by calculating the area of the photographic material from the detection time in which said photographic material is detected and the conveying velocity in which said photographic material is conveyed.

6. A method of controlling drying of a photographic material according to claim 4, wherein the environmental temperature and a relative humidity are detected, and said environmental absolute humidity is calculated from the detected environmental temperature and the relative humidity.

* * * * *